US009341028B2

(12) United States Patent
Buckingham et al.

(10) Patent No.: US 9,341,028 B2
(45) Date of Patent: May 17, 2016

(54) COUNTERWEIGHT ASSEMBLY FOR A SELF-PROPELLED DERRICK RIG ASSEMBLY

(71) Applicant: Black Hawk Energy Services, Bloomfield, NM (US)

(72) Inventors: Stuart Buckingham, Farmington, NM (US); Matt J. Michel, Saint Paul, MN (US)

(73) Assignee: Black Hawk Energy Services Ltd., Williston, ND (US)

( * ) Notice: Subject to any disclaimer, the term of this patent is extended or adjusted under 35 U.S.C. 154(b) by 0 days.

(21) Appl. No.: 13/768,697

(22) Filed: Feb. 15, 2013

(65) Prior Publication Data

US 2014/0232094 A1 Aug. 21, 2014

(51) Int. Cl.
*B66C 23/78* (2006.01)
*E21B 15/00* (2006.01)

(52) U.S. Cl.
CPC ..... *E21B 15/006* (2013.01)

(58) Field of Classification Search
CPC ..... B62C 23/72; B62C 23/74; B62C 23/76; B62C 23/78
USPC ..... 212/195, 196, 197, 198
See application file for complete search history.

(56) References Cited

U.S. PATENT DOCUMENTS 4,103,783 A * 8/1978 Beduhn et al. ..... 212/195
4,170,309 A * 10/1979 Lampson ..... 212/198
4,243,148 A * 1/1981 Lampson ..... 212/196
4,258,852 A * 3/1981 Juergens ..... 212/178
4,361,104 A * 11/1982 Lloyd et al. ..... 114/258
4,579,234 A * 4/1986 Delago et al. ..... 212/178
5,035,337 A * 7/1991 Juergens ..... 212/196
5,407,302 A * 4/1995 Springett et al. ..... 405/196
5,524,777 A * 6/1996 Weber ..... 212/178
5,586,667 A * 12/1996 Landry ..... 212/196
6,131,751 A * 10/2000 Pech et al. ..... 212/178
6,234,253 B1 * 5/2001 Dallas ..... 166/377
6,568,547 B1 * 5/2003 Kretschmer et al. ..... 212/196
7,165,691 B2 * 1/2007 Kimura ..... 212/178
8,100,227 B2 * 1/2012 Southworth ..... 182/130
8,739,989 B2 * 6/2014 Liu et al. ..... 212/195
2003/0172599 A1 * 9/2003 Frink ..... 52/116
2008/0203045 A1 * 8/2008 Pech et al. ..... 212/270
2010/0224583 A1 * 9/2010 Mentink et al. ..... 212/175
2011/0031202 A1 * 2/2011 Pech et al. ..... 212/178
2011/0049075 A1 * 3/2011 Willim ..... 212/279
2011/0079568 A1 * 4/2011 Mau et al. ..... 212/296

(Continued)

OTHER PUBLICATIONS

U.S. Appl. No. 13/768,616, filed Feb. 15. 2013: entitled "Base Beam for Supporting a Self-Propelled Derrick Rig".

(Continued)

*Primary Examiner* — Jeffrey J Restifo
(74) *Attorney, Agent, or Firm* — Hamre, Schumann, Mueller & Larson, P.C.

(57) ABSTRACT

Improvements to base beams and self-propelled derrick rigs are described. The base beam can have two or more stabilizer arms which can be deployed. The base beam is also designed to support the derrick rig. An optional counterweight assembly can be connected to the front of the rig. The self-propelled derrick rig can be easily and quickly mounted to the base beam, and when mounted, the assembly will be able to withstand high hook loads and wind loading without the danger of the rig coming off of its wheels or falling over.

7 Claims, 16 Drawing Sheets

(56) References Cited

U.S. PATENT DOCUMENTS

| | | | | |
|---|---|---|---|---|
| 2011/0164928 | A1* | 7/2011 | Homsi | 405/232 |
| 2013/0270209 | A1* | 10/2013 | Stuehrwoldt et al. | 212/196 |
| 2013/0292352 | A1* | 11/2013 | Zhang et al. | 212/197 |
| 2014/0231067 | A1* | 8/2014 | Buckingham et al. | 166/75.11 |
| 2014/0231098 | A1* | 8/2014 | Buckingham et al. | 166/379 |
| 2014/0231609 | A1* | 8/2014 | Buckingham et al. | 248/346.03 |
| 2014/0232094 | A1* | 8/2014 | Buckingham et al. | 280/762 |

OTHER PUBLICATIONS

U.S. Appl. No. 13/768,672, filed Feb. 15, 2013: entitled "Base Beam and Self-Propelled Derrick Rig Assembly".

U.S. Appl. No. 13/768,738, filed Feb. 15, 2013: entitled "Methods of Supporting a Self-Propelled Derrick Rig".

* cited by examiner

COUNTERWEIGHT ASSEMBLY FOR A SELF-PROPELLED DERRICK RIG ASSEMBLY

FIELD

This disclosure relates to apparatus and methods of stably supporting self-propelled derrick rigs such as workover rigs, drilling rigs, cranes and the like, using a portable base beam.

BACKGROUND

A completion or workover rig is used to do repair work on a well, such as tubing or pump replacement. When a workover rig is used to do repair work on a well, the rig must be able to pull weights near the rated capacity of the derrick of the rig, withstand high wind gusts, and otherwise be stably supported. Further, a workover rig should operate to its design capacity on a high frequency basis, and be highly mobile and self-contained.

A trend in workover rigs to maintain mobility and higher load capacities has been to use guy wires to stabilize the rig. The use of guys can significantly increase the rated capacity of the rig without changing the basic design.

However, there are drawbacks to a guy system. For example, guy wires need to be in specific locations for the stability and safe operation of the rig, and setup time is longer with a guy setup due to the specific locations. In addition, workover rigs typically tie off to permanent anchors set in the ground in a rectangular pattern around the well head. However, with the growing utilization of multi-well pads, it is nearly impossible to guy the workover rig to the anchors that were originally set in the ground when the well was drilled.

Solutions have been sought to solve the problem of a workover rig not being able to be supported by permanent anchors. One solution has been to utilize one or more base beams that are heavy, portable structures placed on the ground and to which the workover rig is guyed. Existing base beams have a relatively small footprint as well as set locations with which to attach guy wires, which makes set-up easier and faster.

SUMMARY

Improvements to base beams and self-propelled derrick rigs are described. A self-propelled derrick rig as used herein is intended to encompass any type of self-propelled vehicle that has a derrick structure mounted on it which can be moved to a raised position during use, a driver's cab and an engine for propelling the vehicle. Examples of self-propelled derrick rigs include, but are not limited to, workover rigs, drilling rigs, cranes and the like.

When the self-propelled derrick rig is mounted to the base beam, the assembly will be able to withstand high hook loads and wind loading without the danger of the rig coming off of its wheels or falling over. The self-propelled derrick rig can be easily and quickly mounted to the base beam. The assembly also allows support equipment, for example a portable pipe handling machine in the case of a workover rig, to work alongside it. In addition, the base beam can be transported as a single load on a vehicle, for example on a flatbed truck.

The base beam includes stabilizer arms that are attached, for example pivotally attached, to the base beam to help stabilize the base beam and the rig itself. A height adjustable stabilizer pad can be connected to each stabilizer arm to help level the stabilizer arms and the base beam on the ground.

In addition, to the base beam, a unique counterweight assembly is described that in use is connected to the front of the rig to help stabilize the rig and prevent the front of the rig from coming off of the ground.

In one embodiment, a base beam that is used to support a self-propelled derrick rig includes a longitudinally extending metal main beam having first and second opposite ends, a front side, a back side, a top and a bottom, where the bottom is substantially planar. The main beam includes a central section approximately midway between the first and second ends thereof on which the derrick structure of the rig will be supported. The central section can reinforced between the top and the bottom, and the top of the central section is substantially planar. First and second stabilizer arms are attached, for example pivotally attached or non-pivotally attached, to the main beam. when pivotally attached, the stabilizer arms are pivotable relative to the main beam between a refracted or transport position where the first and second stabilizer arms are generally parallel to the main beam and a fully extended or deployed position where the first and second stabilizer arms are not parallel to the main beam. In addition, at least one guy attachment point is provided on each of the first and second stabilizer arms to allow guys to attach between the derrick structure and the stabilizer arms.

In another embodiment, there can be a plurality of guy attachment points on the main beam.

In another embodiment, additional stabilizer arms can be provided on the main beam to provide even more stabilization.

In still another embodiment, an assembly is provided that includes a base beam and a self-propelled derrick rig. The base beam can include a longitudinally extending metal main beam having first and second opposite ends, a front side, a back side, a top and a bottom, and a central section. First and second stabilizer arms can be attached, for example pivotally attached or non-pivotally attached, to the main beam. When pivotally attached, the stabilizer arms are pivotable relative to the main beam between a retracted position where the first and second stabilizer arms are generally parallel to the main beam and a fully extended position where the first and second stabilizer arms are not parallel to the main beam. The self-propelled derrick rig can include a derrick structure adjacent a first end of the rig that is disposed in a raised position, a driver's cab, and an engine that provides power for propelling the rig. A base of the derrick structure can be supported on the central section of the main beam on the top thereof. In addition, a plurality of guys extend between the derrick structure and the rig, and a plurality of guys extend between the derrick structure and the base beam.

In yet another embodiment, the counterweight assembly includes a sled that has a mechanism to connect the sled to the self-propelled derrick rig. The connection can be the sled simply resting on the front of the rig to weigh down the front end, or the sled can be removably attached to the rig. A plurality of weights are removably disposed on the sled. Each weight is individually separable from the other weights and each weight is individually removable from the sled.

In another embodiment, a method of supporting a derrick structure of a self-propelled derrick rig is provided, where the derrick structure is disposed adjacent to a first end of the rig and is movable between a raised position and a lowered position. In the method, a base beam is arranged on the ground, and stabilizer arms that are pivotally or non-pivotally connected to the base beam are deployed from a retracted position to a fully deployed position. The self-propelled derrick rig is arranged adjacent to the base beam, and the derrick structure of the self-propelled derrick rig is raised to the raised position. A base end of the derrick structure is attached to the base beam. In addition, a plurality of guys are attached between the derrick structure and the remainder of the rig and a plurality of guys are attached between the derrick structure and the base beam.

In another embodiment of a method, a base beam is arranged on the ground, and the self-propelled derrick rig is arranged adjacent to the base beam. The derrick structure of the self-propelled derrick rig is raised to the raised position, and a base end of the derrick structure is attached to the base beam. A plurality of guys are attached between the derrick structure and the remainder of the rig and a plurality of guys are attached between the derrick structure and the base beam. A counterweight assembly is also connected to the rig at a second end thereof opposite the first end and the derrick structure to weigh down the front of the rig.

DRAWINGS

DETAILED DESCRIPTION

Figure 1:
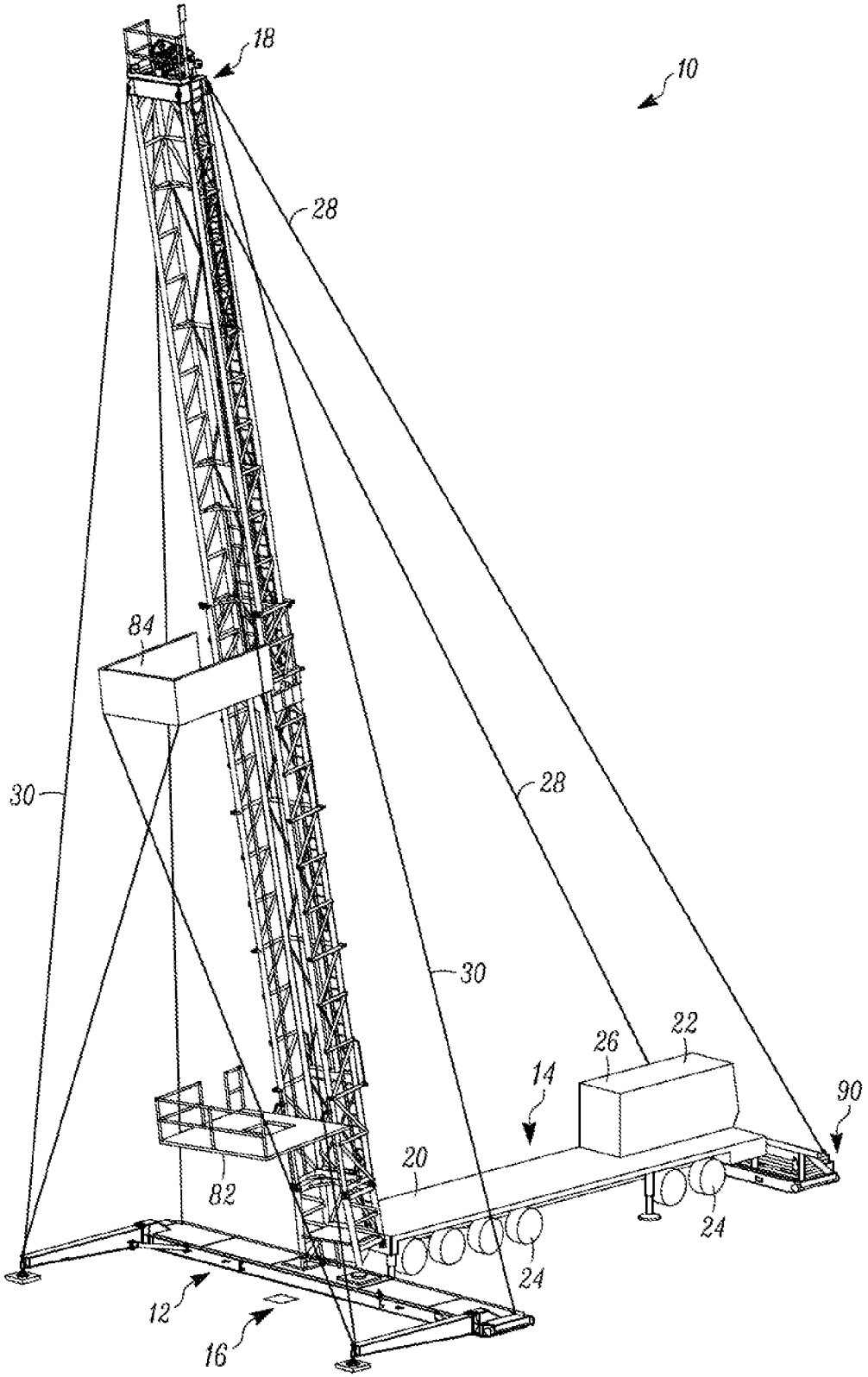
FIG. 1 illustrates an assembly including an exemplary self-propelled derrick rig mounted to an exemplary base beam.

As described in further detail below, an improved base beam is described that is used to support a self-propelled derrick rig. A self-propelled derrick rig as used herein is intended to encompass any type of self-propelled vehicle that has a derrick structure mounted on it which can be moved to a raised position during use, a driver's cab and an engine for propelling the vehicle. Examples of self-propelled derrick rigs include, but are not limited to, workover rigs, drilling rigs, cranes and the like. The self-propelled derrick rig will be described below as, and is illustrated in the drawings as, a workover rig. However, the derrick rig can be any other type of rig that can benefit from being supported using a base beam(s) as described herein.

With reference initially to FIG. 1, an assembly 10 is illustrated that includes a base beam 12 that is shown together with a self-propelled derrick rig 14 in the form of a workover rig. The base beam 12 is disposed adjacent to a well head 16, with the rig 14 being used to perform a service function on the well.

Figure 4:
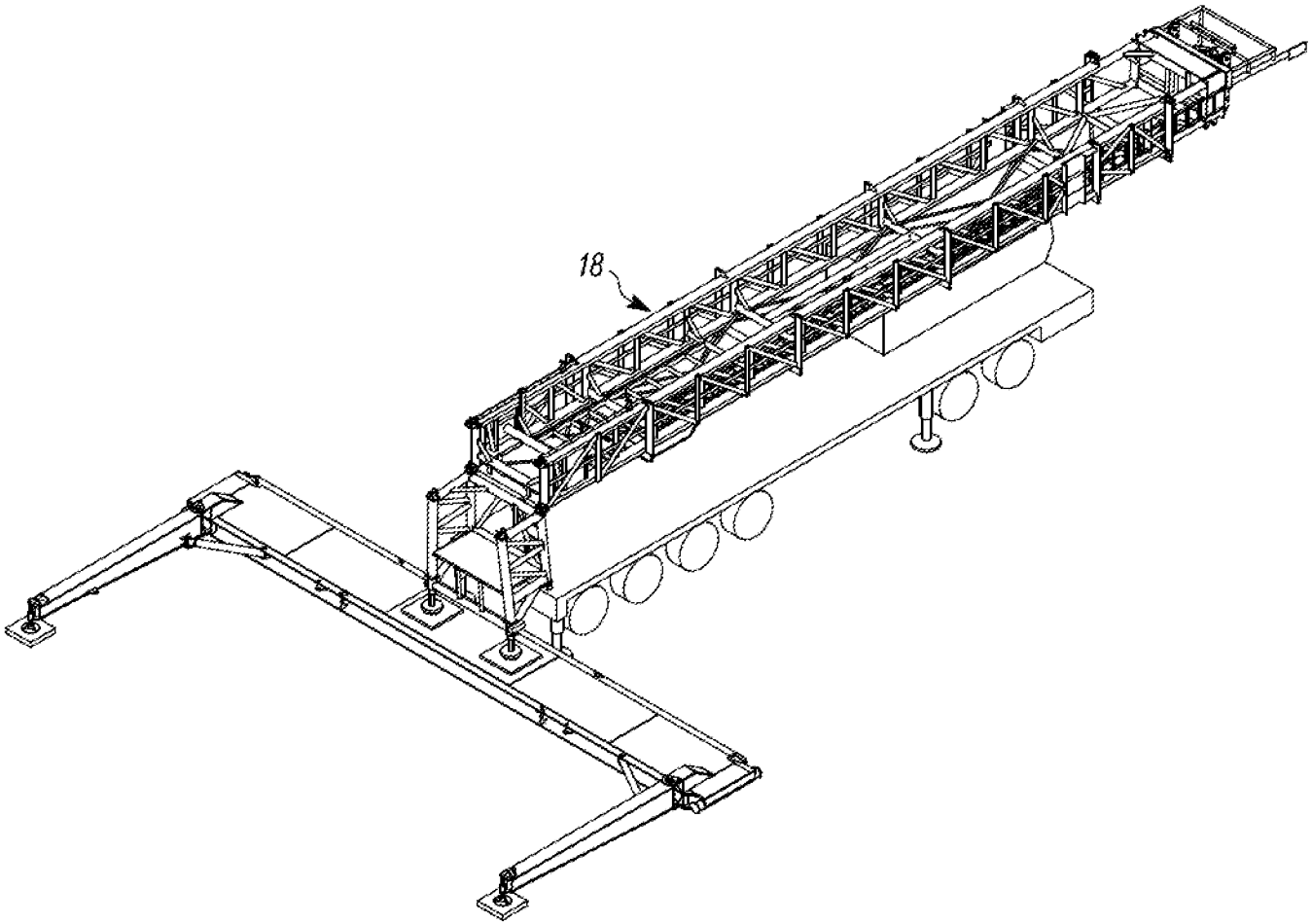
FIG. 4 is a perspective view of the derrick rig and the base beam at a point during assembly.

The rig 14 includes a derrick structure 18 disposed adjacent to a first or rear end of the rig, where the derrick structure includes a raised position (shown in FIG. 1) and a lowered position (shown in FIG. 4). The rig 14 also includes a platform 20, a driver's cab 22 disposed on the platform adjacent to a second or front end of the rig, wheels 24 mounted on the platform 20, and an engine 26 adjacent to the front of the rig that provides power for propelling the rig during driving of the rig.

In the raised position of the derrick structure 18 shown in FIG. 1, a base of the derrick structure 18 is supported on the base beam 12. In addition, a plurality of guys 28 extend between the derrick structure 18 and different points on the remainder of the rig 14, and a plurality of guys 30 extend between the derrick structure 18 and the base beam 12.

Figure 2:
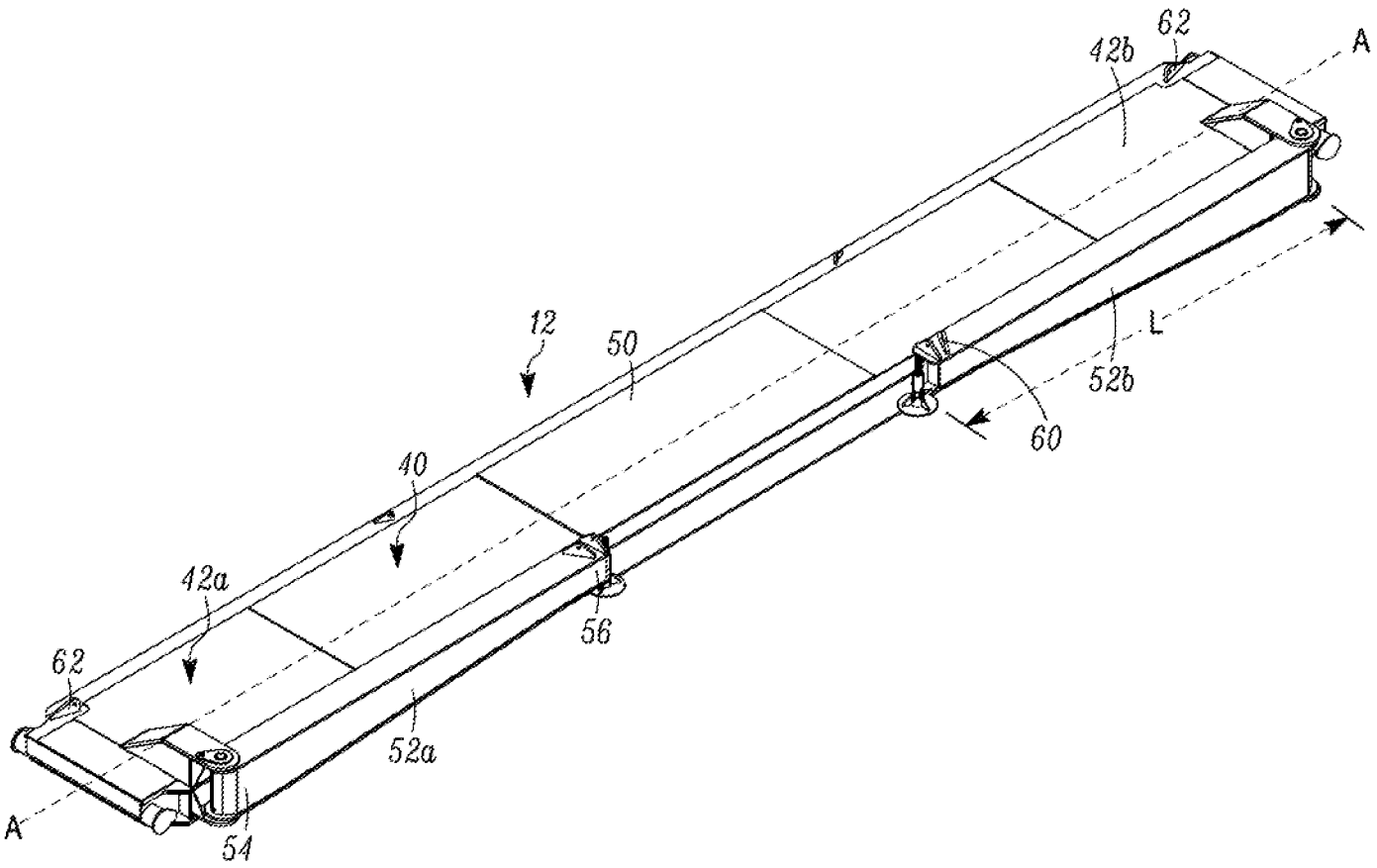
FIG. 2 is a perspective view of the base beam in a folded condition.
Figure 3:
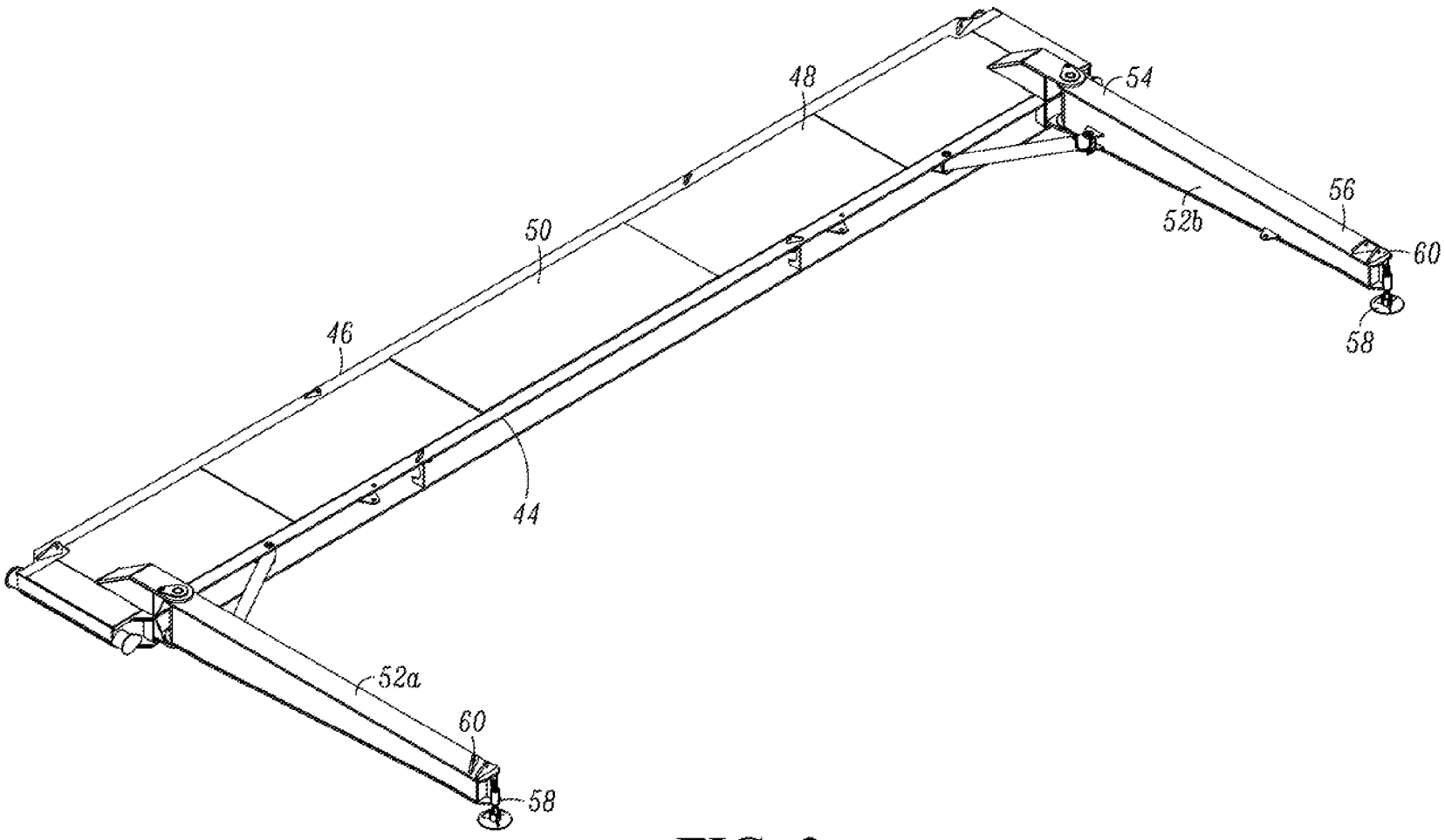
FIG. 3 is a perspective view of the base beam with the stabilizer arms extended.

With reference to FIGS. 2 and 3, the base beam 12 includes a main beam 40 that extends along a longitudinal axis A-A from a first end 42*a* to a second, opposite end 42*b*. The main beam 40 further includes a front side 44, a back side 46, a top 48 and a bottom (not visible in FIGS. 2-3). The bottom is substantially planar to allow the main beam 40 to lay flat on the ground. In the illustrated example, the main beam 40 is generally rectangular in shape, although other shapes could be used.

The main beam 40 further includes a substantially planar central section 50 approximately midway between the first and second ends 42*a*, 42*b* thereof. As discussed further below with respect to FIGS. 4-5, in use the central section 50 supports the base of the derrick structure 18. Therefore, if considered necessary to support the derrick structure, the central section 50 of the main beam can be reinforced between the top 48 and the bottom, for example by employing internal reinforcing members disposed within the main beam 40 at the central section 50.

Further, first and second swing or stabilizer arms 52*a*, 52*b* are pivotally attached to the main beam 40. In the embodiment illustrated in FIGS. 2 and 3, the swing arms 52*a*, 52*b* are pivotally attached to the main beam adjacent to the first and second ends 42*a*, 42*b*, respectively. The swing arms are pivotable relative to the main beam 40 between a retracted position (shown in FIG. 2) where the first and second swing arms are generally parallel to the main beam and a fully extended or deployed position (shown in FIG. 3) where the first and second swing arms are not parallel to the main beam.

In an alternative embodiment, the stabilizer arms can be initially separate from the main beam 40 and then attached to the main beam in the extended or deployed position for use. In this embodiment, the stabilizer arms need not be pivotally attached since the arms are attached for use and detached (or not detached) during transport.

In the illustrated embodiment, when fully deployed, the swing arms 52*a*, 52*b* extend from the front side 44 of the main beam and are disposed at generally right angles to the longitudinal axis A-A. As shown in FIG. 2, each of the first and second swing arms has a length L, and the combined length of the first and second swing arms 52*a*, 52*b* can be less than the longitudinal length of the main beam to permit the swing arms to completely fold to the retracted position parallel to the axis A-A. However, as discussed further below, other configurations of the swing arms are possible.

Each swing arm 52*a*, 52*b* includes a first swing arm end 54 that is pivotally attached to the main beam, and a second swing arm end 56. A stabilizer pad 58 is connected to the second swing arm end 56 of each swing arm. Each stabilizer pad 58 is adjustable in height to allow leveling of the swing arms and the base beam on uneven ground.

The base beam 12 is constructed primarily of a metal material such as steel. The main beam 40 between the top 48 and bottom is generally hollow. However, if additional weight for the base beam 12 is required, weights that are initially separate from the main beam can be disposed on the main beam adjacent to each of the ends 42*a*, 42*b*. In one embodiment, concrete can be poured into the hollow interior of the main beam adjacent to the ends 42*a*, 42*b* to increase the weight of the base beam. In another embodiment, removable weights can be placed on top of the main beam adjacent to the ends thereof. However, any technique for adding weight to the base beam 12 to increase the weight of the beam can be used.

The base beam 12 further includes a plurality of guy attachment points to permit attachment to the guys 30. The guy attachment points can be provided at locations that one determines to be suitable for adequately guying the derrick structure 18. In the embodiment illustrated in FIGS. 2 and 3, there is at least one guy attachment point 60 on each of the first and second swing arms, for example adjacent to the second ends 56. In addition, there can be a plurality of guy attachment points 62 on the main beam 40, for example adjacent to the ends 42*a*, 42*b*. The guy attachment points 60, 62 can be, for example, flanges that are attached to the base beam 12 and that include a hole to permit attachment of one end of the guys. The guys 30 (as well as the guys 28) can be wires or any structure suitable for use as guys.

Figure 10:
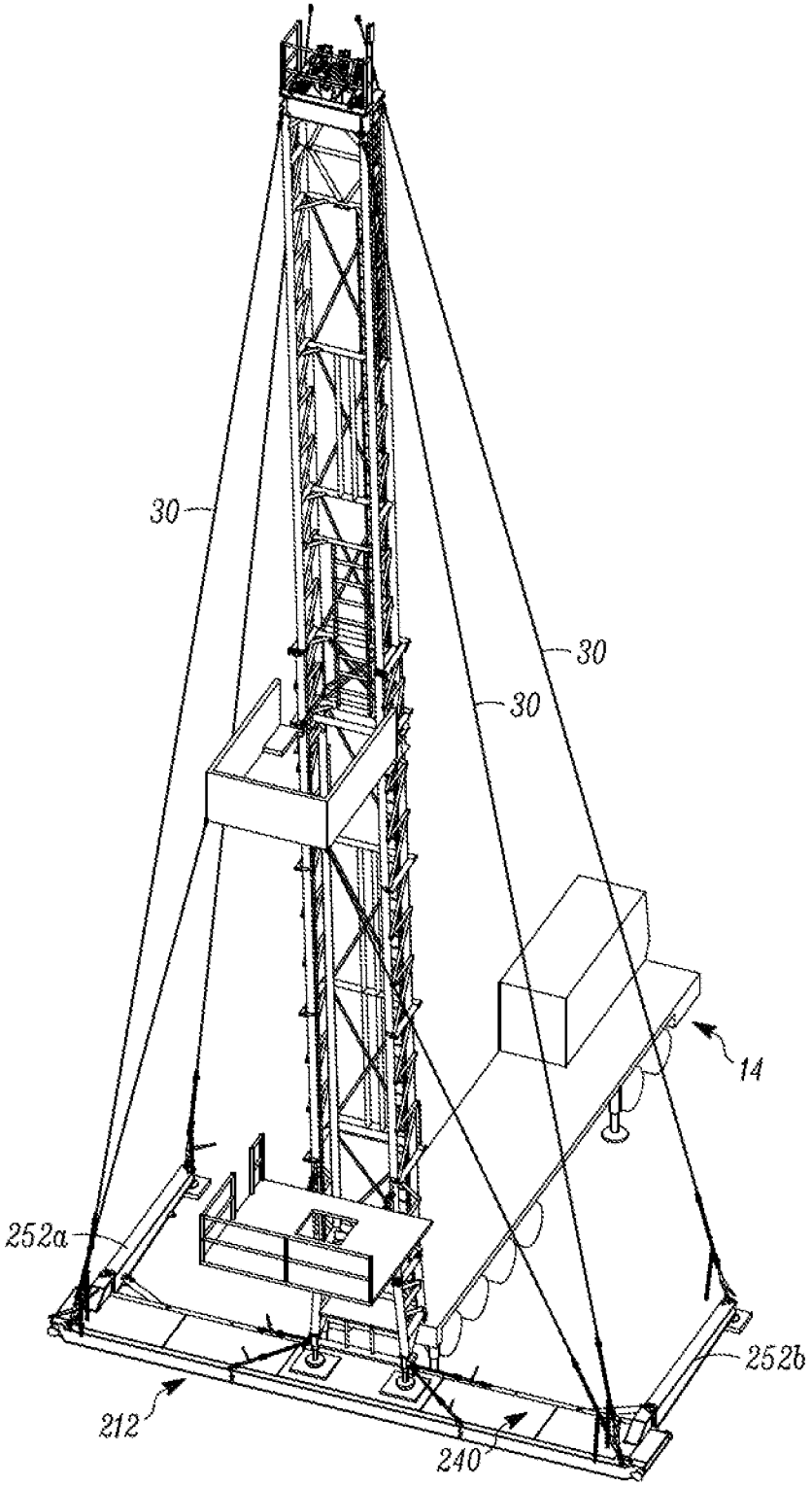
FIG. 10 illustrates an alternative embodiment of a base beam.

Other configurations of the base beam are possible. For example, FIG. 10 illustrates a base beam 212 with a main beam 240 and a pair of swing arms 252*a*, 252*b* pivotally attached to the main beam 240 for pivoting movement between a retracted position (not shown) where the first and second swing arms are generally parallel to the main beam and a fully extended or deployed position (shown in FIG. 10) where the first and second swing arms are not parallel to the main beam. In this embodiment, the swing arms are pivotally attached to the main beam 240 so that the first and second arms 252*a*, 252*b* extend from a back side of the main beam when in the fully extended position in a direction generally toward the front end of the rig 14 and parallel to the rig.

Figure 11:
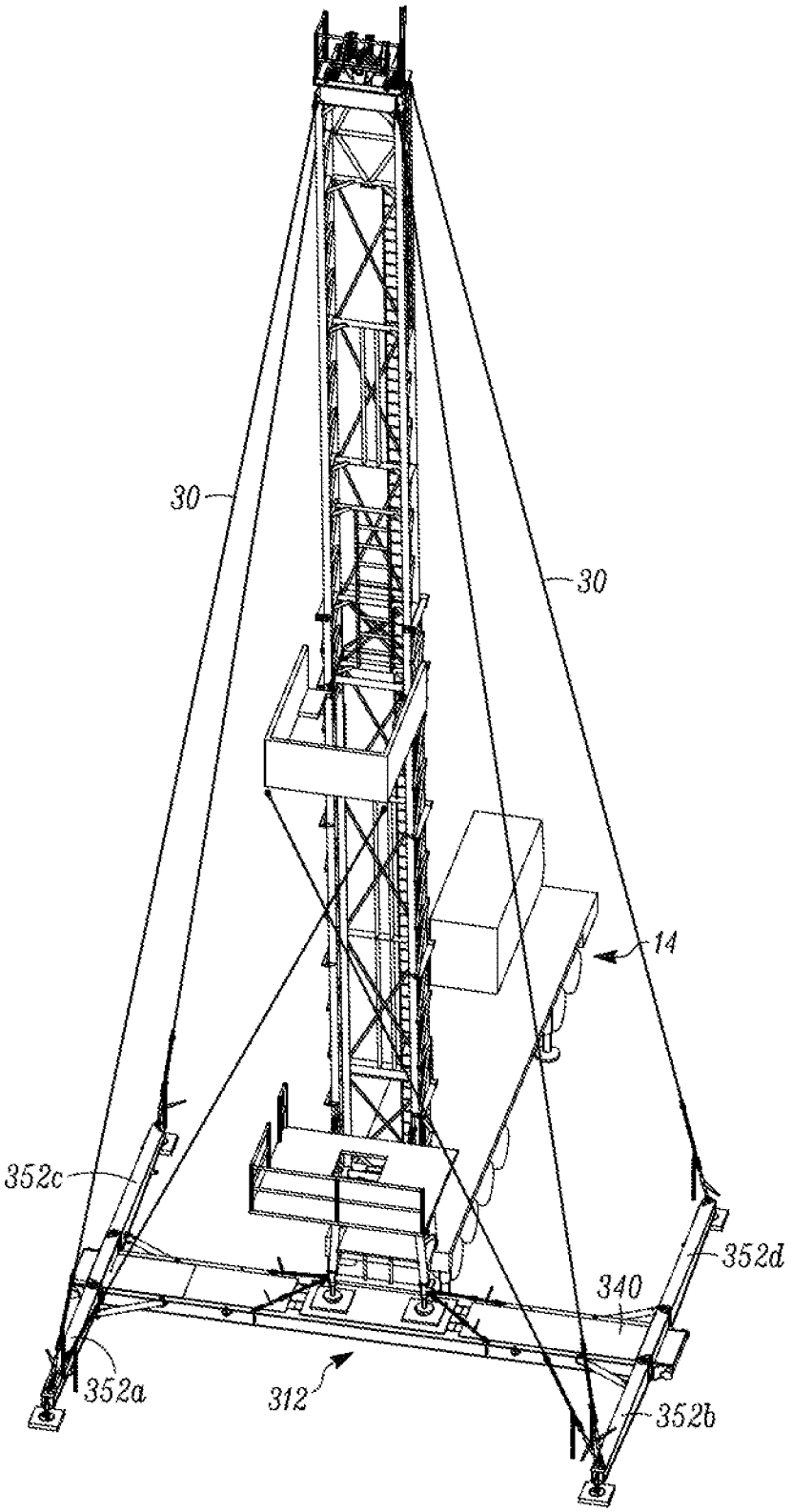
FIG. 11 illustrates another alternative embodiment of a base beam.

FIG. 11 illustrates a base beam 312 with a main beam 340 and two pairs of swing arms 352*a*, 352*b*, 352*c*, 352*d* pivotally attached to the main beam 340 for pivoting movement between a retracted position (not shown) where the swing arms are generally parallel to the main beam and a fully extended or deployed position (shown in FIG. 11) where the swing arms are not parallel to the main beam. In this embodiment, the swing arms are pivotally attached to the main beam 340 so that the swing arms 352*a*, 352*b* extend from a front side of the main beam similar to FIGS. 2-3, while the swings arms 352*c*, 352*d* extend from the back side of the main beam similar to FIG. 10.

Figure 12A:
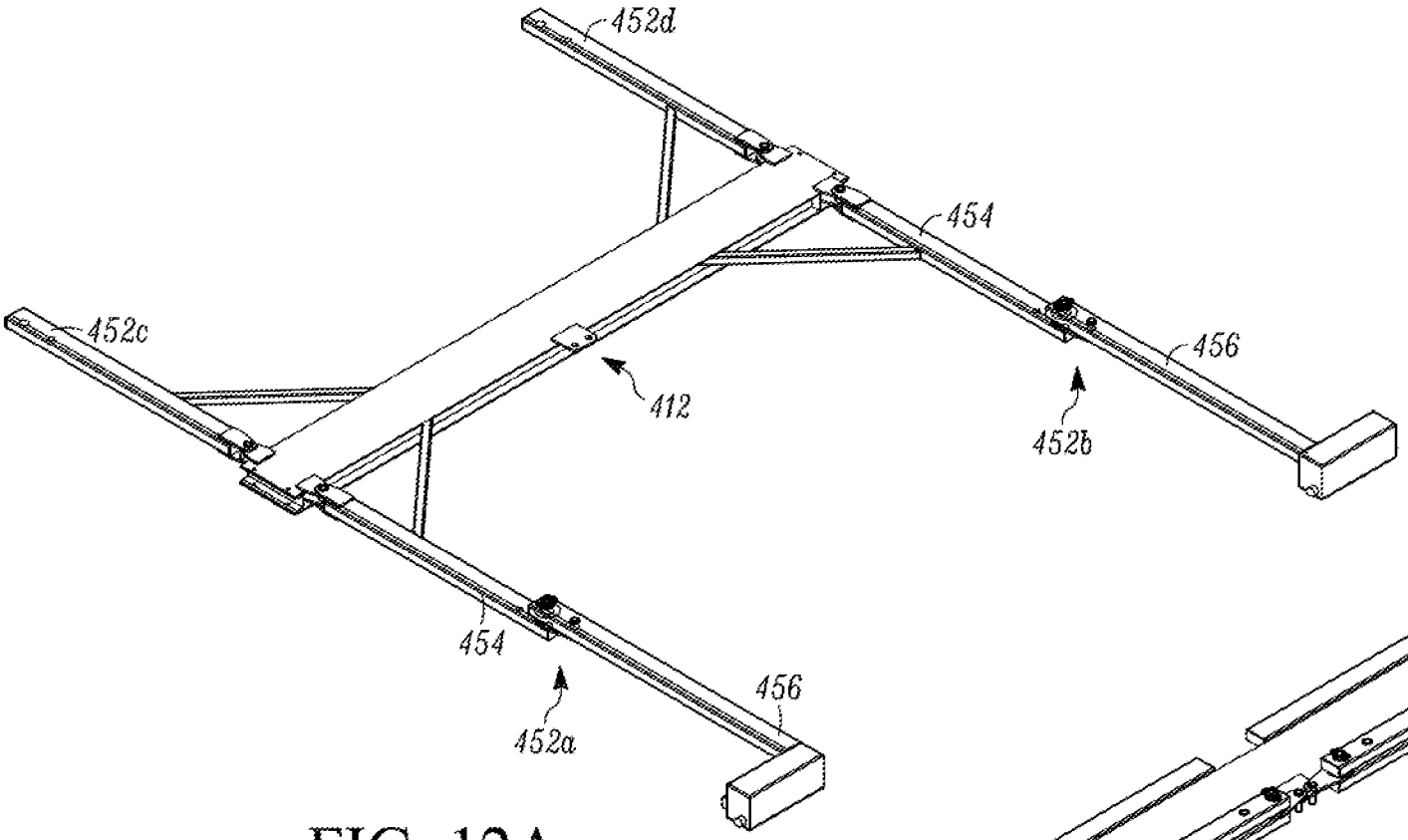
FIGS. 12A and 12B illustrate still another alternative embodiment of a base beam in extended and folded conditions, respectively.
Figure 12B:
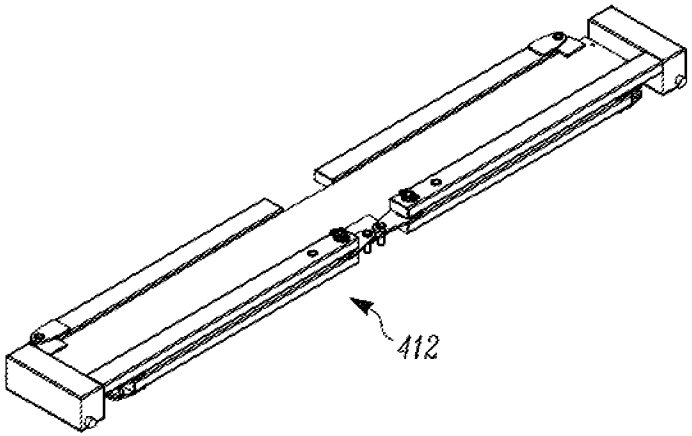

FIGS. 12A and 12B illustrate a base beam 412 with a main beam 440 and two pairs of swing arms 452*a*, 452*b*, 452*c*, 452*d* pivotally attached to the main beam 440 for pivoting movement between a retracted position (shown in FIG. 12B) where the swing arms are generally parallel to the main beam and a fully extended or deployed position (shown in FIG. 12A) where the swing arms are not parallel to the main beam. In this embodiment, the swing arms are pivotally attached to the main beam 440 so they extend from the front and back sides of the main beam similar to FIG. 11. In addition, each of the swing arms 452*a*, 452*b* includes a first section 454 that is pivotally attached to the main beam and a second section 456 that is pivotally attached to the first section. Constructing the arms 452*a*, 452*b* with two sections allows the two sections 454, 456 to fold together, for example one above the other as shown in FIG. 12B, which allows the length of the arms to be increased, while allowing the arm sections 454, 456 to fold to the retracted position.

Figure 14:
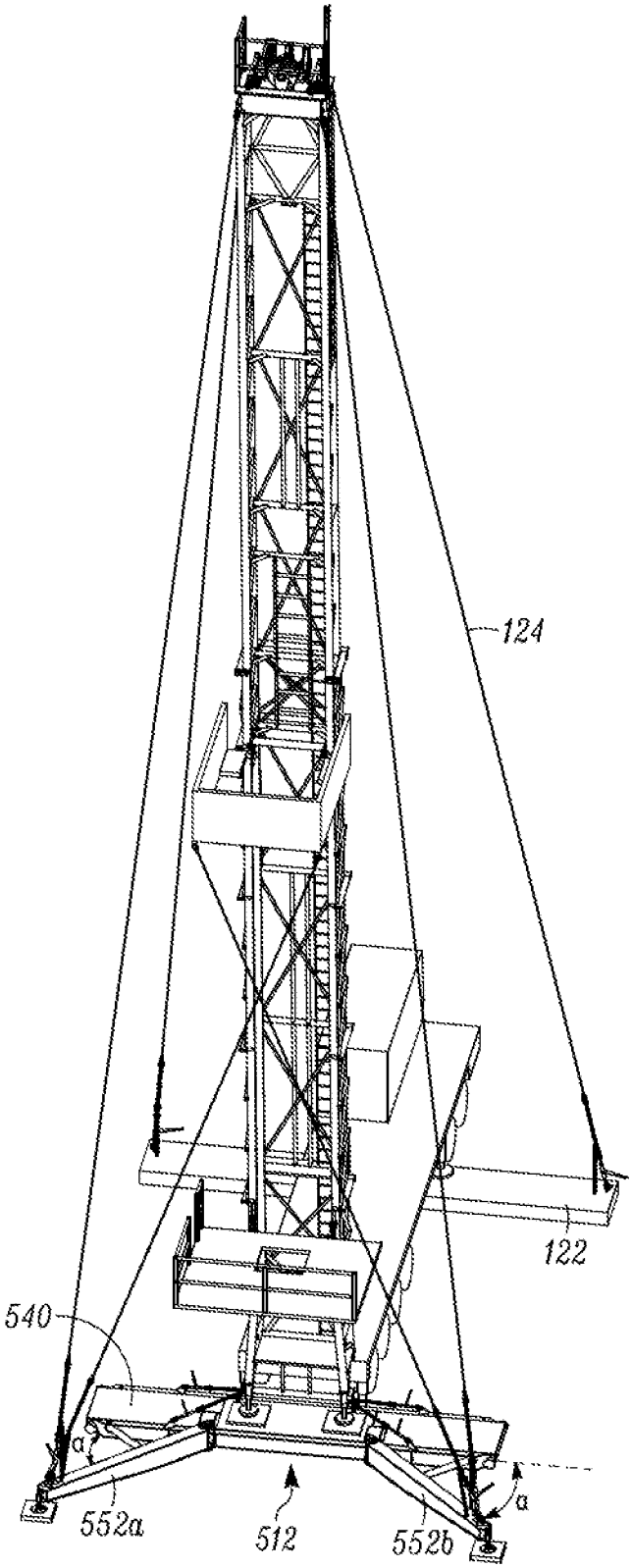
FIG. 14 illustrates still another alternative embodiment of an assembly of a derrick rig and a base beam.

FIG. 14 illustrate a base beam 512 with a main beam 540 and a pair of swing arms 552*a*, 552*b* pivotally attached to the main beam 540 for pivoting movement between a retracted position (not shown) where the swing arms are generally parallel to the main beam and a fully extended or deployed position (shown in FIG. 14) where the swing arms are not parallel to the main beam. In this embodiment, the swing arms 552*a*, 552*b* are pivotally attached to the main beam 540 away from the ends of the beam 540 and more toward the center of the main beam. In addition, the swing arms do not extend at right angles to the main beam as in the other embodiments. Instead, the swing arms 552*a*, 552*b* are disposed at acute angles $\alpha$ relative to the longitudinal axis of the main beam.

Figure 5:
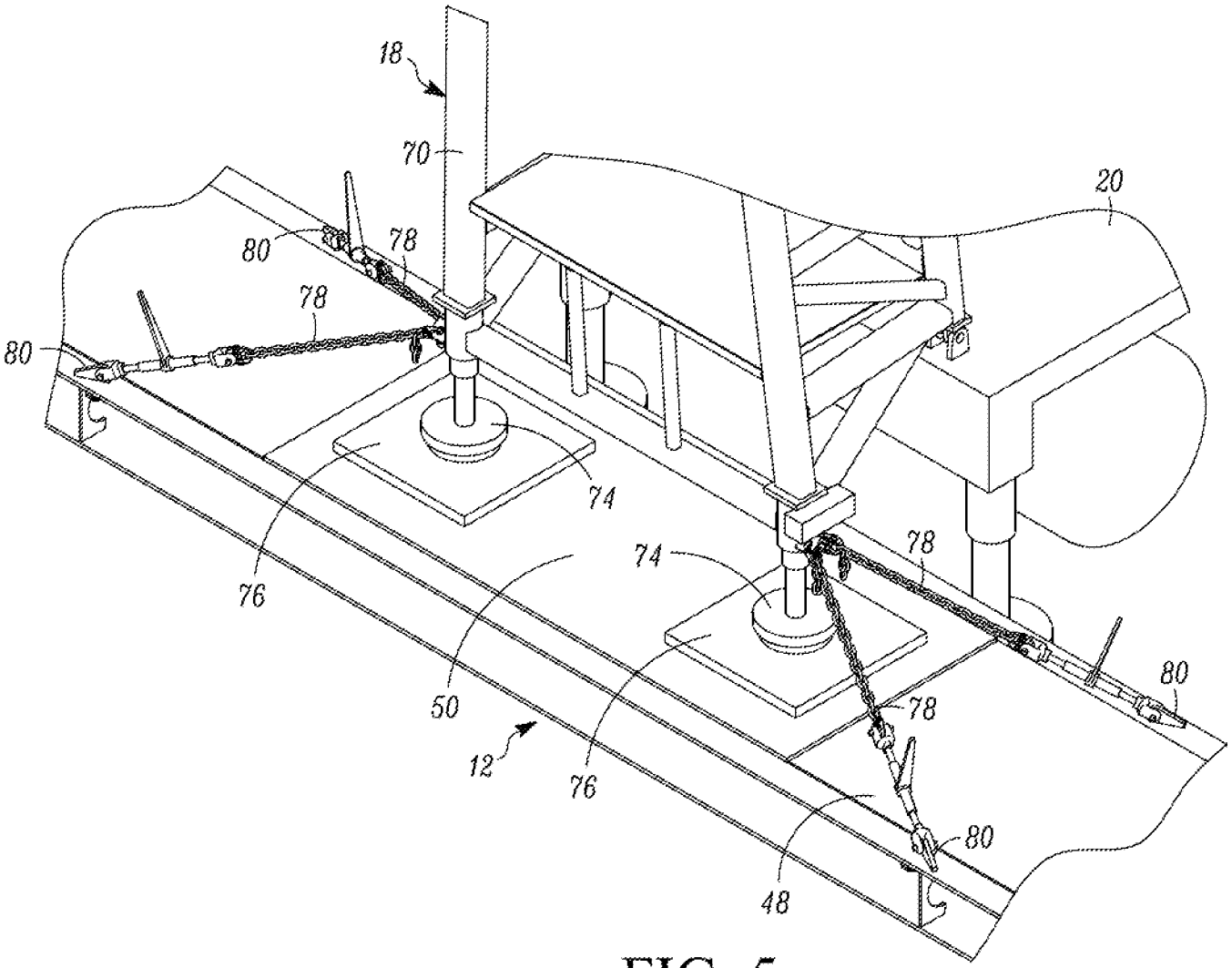
FIG. 5 is a close up view detailing an exemplary technique for fixing the derrick of the rig to the base beam.

Returning now to FIGS. 1-3 together with FIGS. 4-5, in use, the base beam is transported to a position adjacent to the well head 16 and arranged on the ground. The swing arms are then deployed from the retracted position, which is used during transport of the base beam, to the fully deployed position. If necessary, the stabilizer pads 58 are adjusted in height to level the swing arms and the main beam. The self-propelled derrick rig 14 is then backed up to a position adjacent to the base beam as shown in FIG. 4. During this time, the derrick structure 18 is likely at its lowered or transport position as shown in FIG. 4, although in some circumstances the derrick structure could already be raised or partially raised. If the derrick structure is not raised, the derrick structure is raised to the raised position shown in FIG. 1.

With reference to FIG. 5, once the derrick structure 18 is raised, a base end 70 of the derrick structure is attached to the base beam 12. In particular, one side of the base end 70 is pivotally connected to the rig platform 20 by pivots 72. The other side of the base end is provided with a pair of height adjustable stabilizer pads 74. Metal plates 76 are laid on the top 48 of the main beam at the central section 50, and the pads 74 rest on the plates 74. The base end 70 is fixed to the main beam by one or more fixation members 78. In one embodiment, four fixation members 78 can be used, each of which attaches at one end to the base end 70 of the derrick structure 18 and attach at opposite ends thereof to mounting fixtures 80 that are disposed adjacent to the front side and the back side respectively of the main beam adjacent to, and on opposite sides of, the central section 50. In the illustrated embodiment, the fixation members 78 comprise shackles, although any type of fixation members that can adequately attach the base end of the derrick structure to the main beam can be used.

In addition, as shown in FIG. 1, the guys 28 are then attached between the derrick structure and the remainder of the rig, and the guys 30 are attached between the derrick structure and the base beam. FIG. 1 illustrates the derrick structure 18 as including a rig floor 82 and a tubing or racking board 84 both of which are conventional structures on workover rigs. The guys 28 are illustrated as generally extending from the top of the derrick structure to other points on the rig. Some of the guys 30 extend from the base beam to the top of the derrick structure, while some of the guys 30 extend from the base beam to the tubing board 84 and from the tubing board to the top of the derrick structure. However, the exact arrangement and number of the guys 28, 30 can vary based on a number of factors, such as the expected loading conditions on the derrick structure and the rig. Therefore, the guy arrangement illustrated in FIG. 1 is exemplary only and can vary from the illustrated arrangement both in the number of guys 28, 30 used and their locations.

Under some loading conditions, for example when the derrick structure is pulling at or near capacity, the front end of the rig 14 may want to come off the ground. To prevent such an occurrence, an optional counterweight assembly 90 can be used that is connected to the front end of the rig 14 to weigh down the front of the rig. The assembly 90 can simply connect to the front of the rig by resting on some portion of the front. Alternatively, the assembly 90 can be connected to the rig by removably attaching the assembly to the rig, for example by pinning or bolting the assembly to the rig. Any form of connection can be used as long as the assembly 90 increases the weight of the front of the rig.

Figure 6:
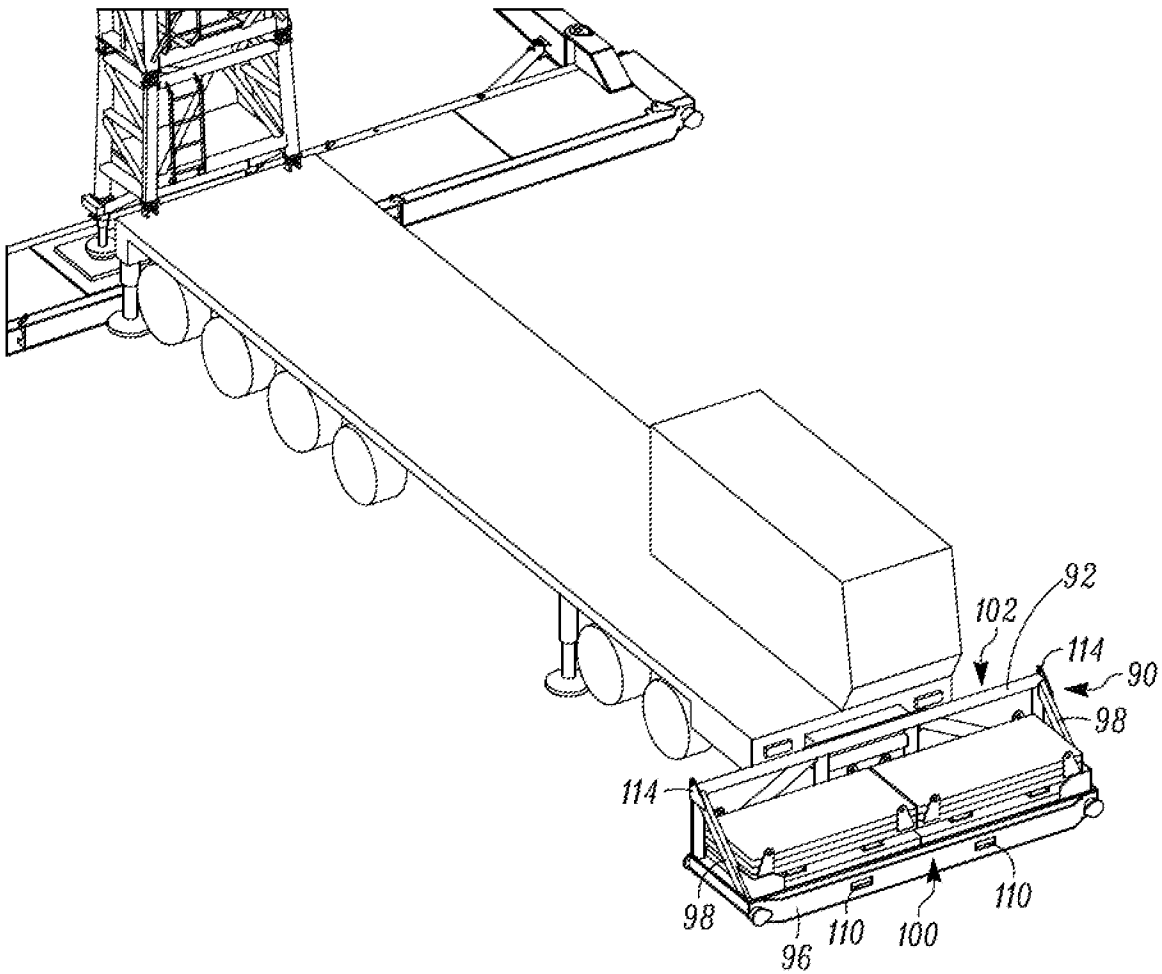
FIG. 6 is a perspective view of the front of the derrick rig showing a counterweight assembly in place.
Figure 7:
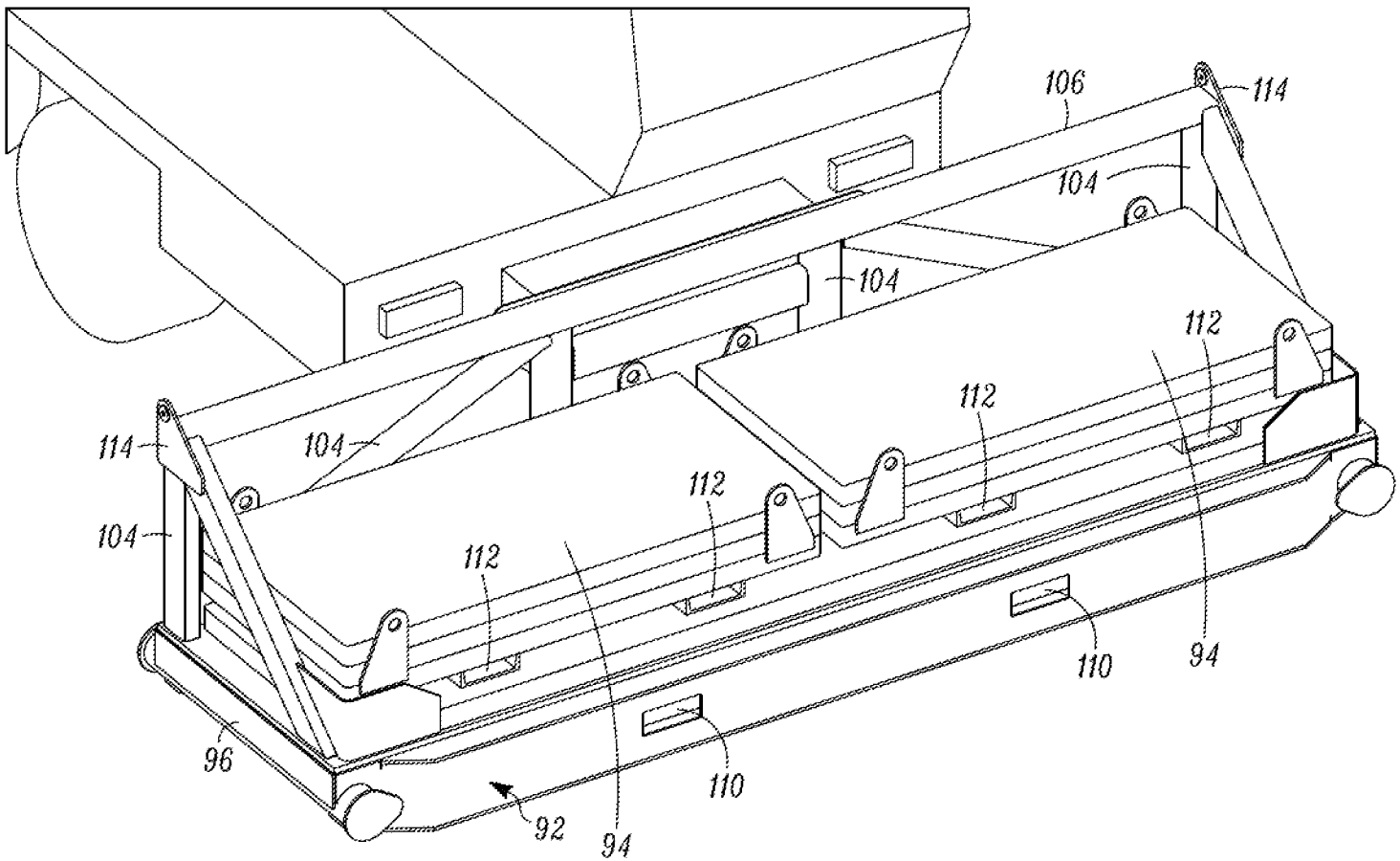
FIG. 7 is a detailed view of the counterweight assembly of FIG. 6.
Figure 8:
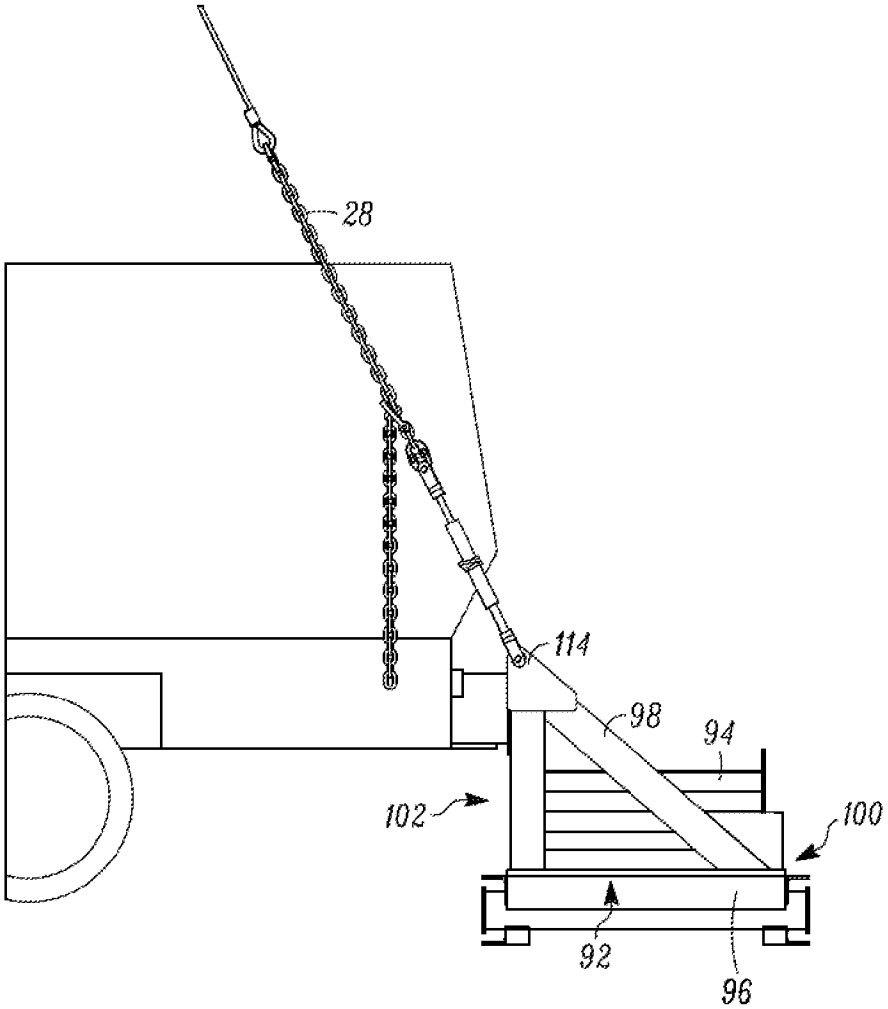
FIG. 8 is a side view of the counterweight assembly of FIG. 6.

With reference to FIGS. 6-8, the counterweight assembly 90 can include a sled 92 that is designed to connect to the rig 14 and carry separate weights 94 that can be added and removed from the sled 92 to alter the amount of weight carried by the sled.

The sled 92 is a generally rectangular structure that includes a base 96, reinforcing members 98 at each side end of the base, a front side 100 and a rear side 102. The rear side 102 of the sled 92 includes a plurality of vertical beams 104 connected at base ends thereof to the base 96 and at upper ends thereof to a horizontal beam 106. As best seen in FIG. 8, the horizontal beam 106 and/or the beams 104 can be connected to a block, for example of wood, that rests on a ledge at the front of the rig. Thus, the assembly 90 weights down the front end of the rig.

Figure 16:
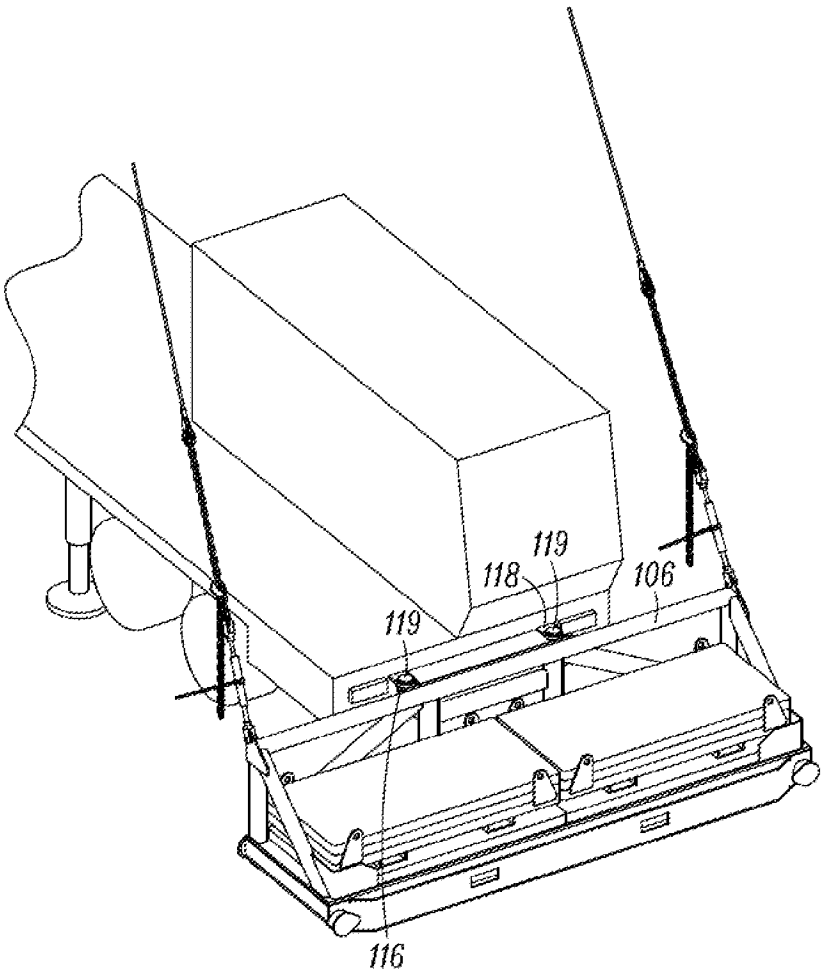
FIG. 16 illustrates an exemplary attachment between the counterweight assembly and the rig.

If there is concern that the assembly could move, the assembly could be removably attached to the rig. For example, with reference to FIG. 16, the attachment mechanism can comprise flanges 116 that are fixed to the beam 106 and/or the beams 104, with corresponding flanges 118 on the front of the rig that align with the flanges on the sled. Pins or bolts 119 can then extend through holes in the aligned flanges to attach the sled to the rig.

Each weight 94 is individually separable from the other weights 94 and each weight is individually removable from the sled 92. The weights 94 are generally rectangular in shape and resemble plates. The sled can be designed to hold any number of weights, based in part on how much counterweight one may need.

To aid in mounting, removal and transport of the sled 92, at least two forklift pockets 110 are formed in the base 96. The forklift pockets 110 permit a forklift to lift and transport the sled 92. Similarly, each of the weights 94 includes at least two forklift pockets 112 formed therein. The forklift pockets 112 permit a forklift to lift and transport each of the individual weights 94. Instead of forklift pockets, any structure that performs a function similar to the forklift pockets can be used.

The sled 92 further includes at least one guy attachment point 114. For example, in the illustrated embodiment, the sled includes a plurality of the guy attachment points 114, with the guy attachment points being located at the rear side 102 of the sled. As best seen in FIGS. 1 and 8, two guys 28 extend from the derrick structure 18 to the attachment points 114 to guy the counterweight assembly to the derrick structure.

Figure 9:
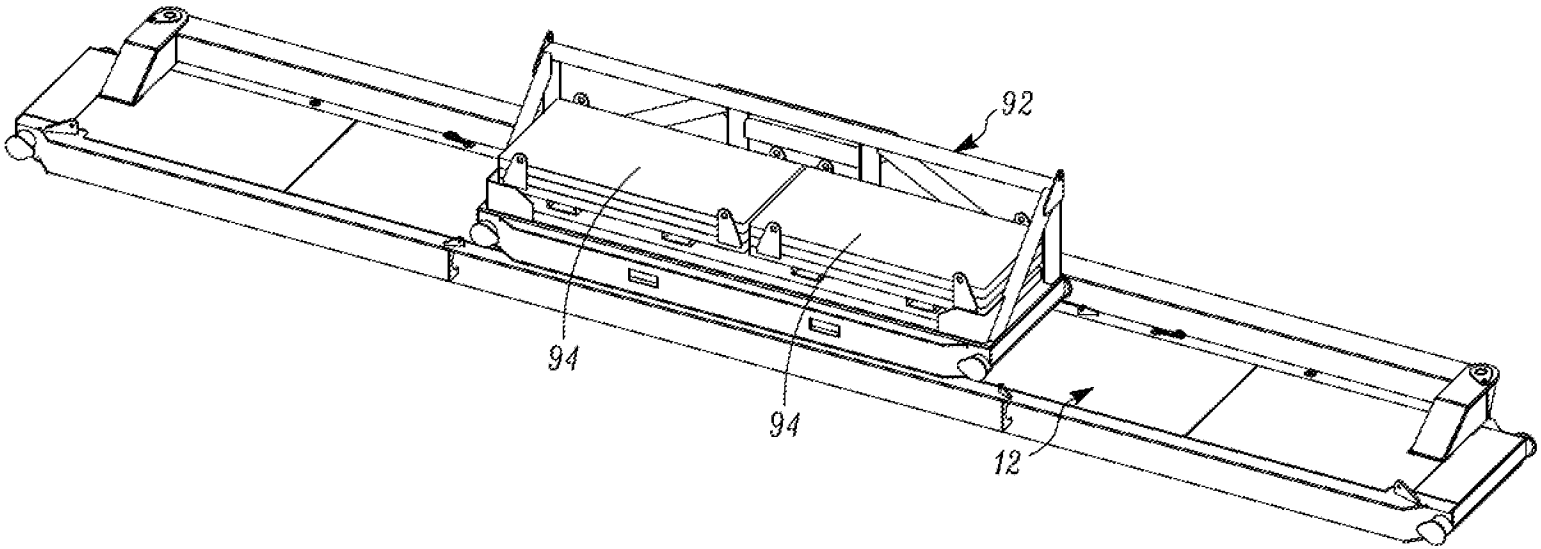
FIG. 9 illustrates the counterweight assembly disposed on top of the base beam during transport.

With reference to FIG. 9, the shape of the sled 92 is such that the sled 92 together with any weights held thereon can be disposed on the base beam 12 during transport of the base beam and the counterweight assembly. This minimizes the space taken up during transport.

Figure 13:
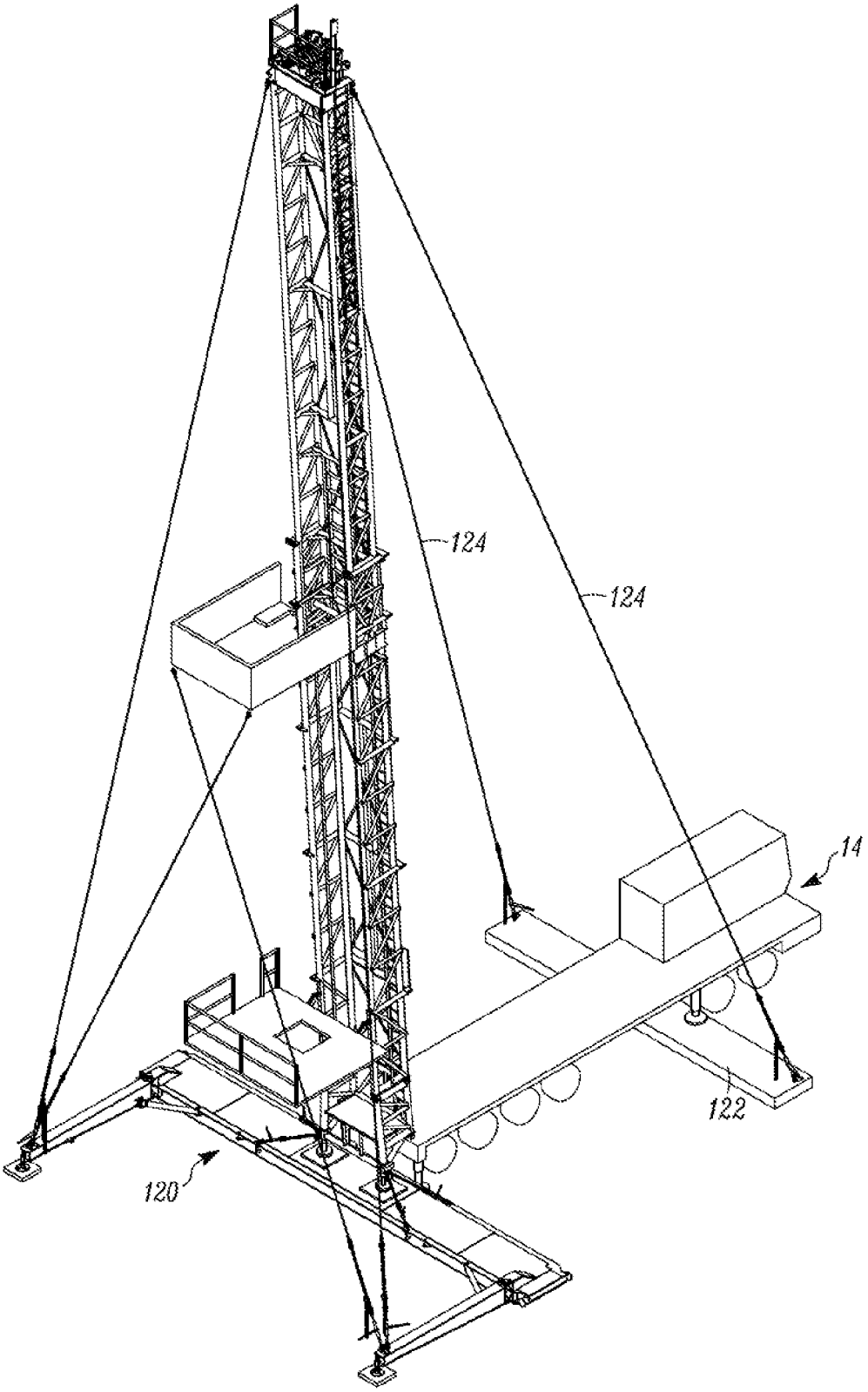
FIG. 13 illustrates another alternative embodiment of an assembly of a self-propelled derrick rig and a base beam.

With reference to FIG. 13, an embodiment is illustrated that uses two base beams. One base beam 120 is substantially similar to the base beam 12. Alternatively, the base beam 120 could be similar to the base beams 212, 312, 412, or 512. A second base beam 122 is disposed underneath the rig 14, for example underneath jacks or outriggers that are provided on the rig 14. The construction and use of jacks or outriggers on rigs is well known in the art. In this embodiment, guys 124 extend from the derrick structure 18 and are connected to the ends of the second base beam 122 to help support the derrick structure.

FIG. 14 shows another embodiment that is similar to FIG. 13, but using the base beam 512 together with the second base beam 122.

Figure 15:
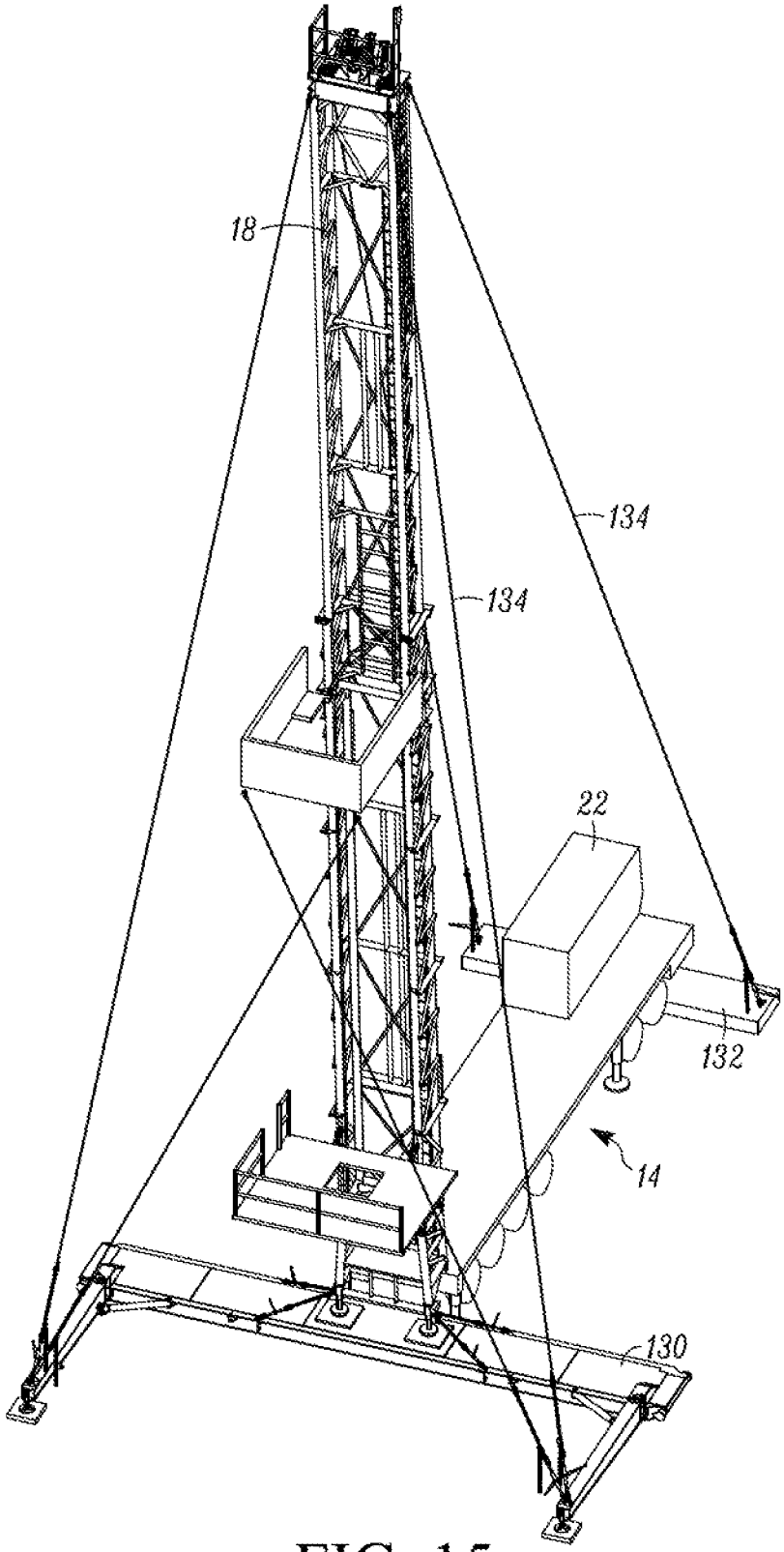
FIG. 15 illustrates still another alternative embodiment of an assembly of a derrick rig and a base beam.

FIG. 15 shows another embodiment that uses two base beams, including one base beam 130 that is substantially similar to the base beam 12. In this embodiment, a second base beam 132 is disposed underneath the rig 14 at a location that is further forward than the second base beam 122 in FIG. 13. For example, the second base beam 132 can be disposed underneath jacks disposed under the driver's cab 22, and guys 134 extend from the derrick structure 18 and are connected to the ends of the base beam 132 to help support the derrick structure.

The second base beams 122, 132 illustrated in FIGS. 13-15 are depicted as not including swing arms. However, the second base beams 122, 132 could be configured to have swing arms similar to those discussed above.

The individual features of the various embodiments described herein can be used individually or in any combination with any other embodiment described herein.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A counterweight assembly configured for connection to a self-propelled derrick rig, comprising:

a sled that is configured to connect to the self-propelled derrick rig; the sled includes a front side and a rear side with an upper edge; the sled includes a plurality of guy attachment points, the guy attachment points are located at the upper edge of the rear side of the sled;

the sled includes a base, vertical beams at the rear side that are connected to the base, a horizontal beam that is connected to the vertical beams, and angled reinforcing members that are connected to the base at the front side and connected to the vertical beams and the horizontal beam at the rear side; and a plurality of weights removably disposed on the sled, each weight is individually separable from the other weights and each weight is individually removable from the sled.

2. The counterweight assembly of claim 1, wherein the rear side is configured to connect to the self-propelled derrick rig, and the front side includes at least two forklift pockets formed therein.

3. The counterweight assembly of claim 2, wherein each of the weights includes at least two forklift pockets formed therein.

4. A counterweight assembly configured for connection to a self-propelled derrick rig, comprising:

a sled that is configured to connect to the self-propelled derrick rig; the sled includes a front side and a rear side with an upper edge; the sled includes a plurality of guy attachment points, the guy attachment points are located at the upper edge of the rear side of the sled;

the sled includes first and second opposite ends, one of the guy attachment points is positioned at the first end, and one of the guy attachment points is positioned at the second end; and a plurality of weights removably disposed on the sled, each weight is individually separable from the other weights and each weight is individually removable from the sled.

5. The counterweight assembly of claim 1, wherein the sled is generally rectangular and the weights are generally rectangular.

6. The counterweight assembly of claim 1, wherein the sled is configured to be removably attached to a front end of the self-propelled derrick rig.

7. The counterweight assembly of claim 6, wherein the sled is configured to be removably attached by pins to the front end of the self-propelled derrick rig.

* * * * *